US005503591A

United States Patent [19]

Morikawa et al.

[11] Patent Number: 5,503,591

[45] Date of Patent: Apr. 2, 1996

[54] APPARATUS FOR DECONTAMINATING SUBSTANCES CONTAMINATED WITH RADIOACTIVITY

[75] Inventors: Kenji Morikawa; Yasuo Shimizu, both of Kohshoku; Akira Doi, Toguramachi, all of Japan

[73] Assignee: Morikawa Sangyo Kabushiki Kaisha, Japan

[21] Appl. No.: 225,398

[22] Filed: Apr. 8, 1994

Related U.S. Application Data

[63] Continuation-in-part of Ser. No. 671,940, Mar. 19, 1991, Pat. No. 5,302,324.

[30] Foreign Application Priority Data

Mar. 20, 1990 [JP] Japan ..... 2-71144

[51] Int. Cl.[6] ..... B24C 3/00

[52] U.S. Cl. ..... 451/75; 451/39

[58] Field of Search ..... 451/75, 99, 89, 451/87, 36, 38, 40, 2, 88, 39; 252/626; 134/7, 10, 11, 12, 26, 1, 2

[56] References Cited

U.S. PATENT DOCUMENTS

| | | | |
|---|---|---|---|
| 3,013,909 | 12/1961 | Pancer et al. | 134/3 |
| 3,080,262 | 3/1963 | Newman | 134/3 |
| 3,778,938 | 12/1973 | Korn et al. | 451/39 |
| 3,802,916 | 4/1974 | Jackson | 134/10 |
| 3,894,364 | 7/1975 | Korn et al. | 451/39 |
| 3,895,465 | 7/1975 | Korn et al. | 451/39 |
| 4,443,269 | 4/1984 | Capella et al. | 134/12 |
| 4,724,853 | 2/1988 | Hirose | 134/1 |
| 4,771,579 | 9/1988 | Giese | 451/88 |
| 4,800,063 | 1/1989 | Mierswa et al. | 376/316 |
| 5,046,289 | 9/1991 | Bengel et al. | 451/76 |

*Primary Examiner*—Bruce M. Kisliuk
*Assistant Examiner*—Derris Banks
*Attorney, Agent, or Firm*—Klima & Hopkins

[57] ABSTRACT

The present invention is directed to an apparatus for decontaminating radioactive items such as parts and machinery including means for shotblasting or sandblasting to remove the radioactivity, means for cleaning the substance with a cleaning solution, means for washing the grit used to shotblast or sandblast with a washing solution, means for filtering the washing solution, and means for decontaminating the filtered washing solution by purifying it. The apparatus includes means for decontaminating washing solution to allow reuse thereof.

11 Claims, 4 Drawing Sheets

APPARATUS FOR DECONTAMINATING SUBSTANCES CONTAMINATED WITH RADIOACTIVITY

This is a is continuation-in-part application of U.S. patent application Ser. No. 07/671,940, filed Mar. 19, 1991, now U.S. Pat. No. 5,302,327 herein incorporated by reference in its entirety.

FIELD OF THE INVENTION

The present invention relates to an apparatus for the decontamination of equipment and parts contaminated with radioactivity. Further, the present invention further relates to an apparatus for decontaminating materials such as grit generated from shotblasting or sandblasting used in a method of decontaminating the equipment and parts contaminated with radioactivity so that the contaminated materials can be reused.

BACKGROUND OF THE INVENTION

Presently, nuclear power facilities generate significant amounts of radioactive waste over time. Further, equipment and parts utilized in such facilities also become contaminated with radioactivity. In order to decontaminate such radioactive equipment and parts, the equipment and parts are simply disposed of and replaced during routine inspection and overhaul.

Another current techniques includes coating equipment and parts with a removable layer, and subsequently decontaminating the equipment and parts by removing the contaminated layer and then coating with a new layer. However, this method of coating is problematic in that it is costly and inefficient with respect to effectively removing contamination. Likewise, radioactive waste (i.e. both equipment and liquid radioactive waste) is currently dealt with by confining it to metal drums and dumping such drums in nuclear waste storage facilities, abandoned mines, or sparsely populated rural areas.

As discussed above, contaminated equipment is presently decontaminated only by disposal and replacement. That is, prior to the present invention no efficient method for decontaminating and reusing such equipment was known.

There are several problems with the current practice of disposal and replacement. Specifically, such practice is costly, inefficient and unsafe. The practice of disposal and replacement is unsafe because replacement is infrequent, thus, allowing the accumulation of radioactive contamination to reach levels well above safe levels.

The quantity of radioactive waste produced and dumped increases tremendously every year. As a result, there are fewer and fewer dump sites. This reduced number of existing dump sites when considered along with the population's ever increasing concern with the environment, results in too few new dump sites to meet current and future demands.

The present invention solves the problem of disposal and replacement by providing a method for decontaminating substances contaminated with radioactivity which method reduces radioactivity to a level which falls within the safety standards set by OSHA, thus, allowing such decontaminated substances to be reused or disposed of as general industrial waste.

SUMMARY OF THE INVENTION

An object of the present invention is to provide an apparatus for decontaminating an item such as parts and machinery contaminated with radioactivity.

Another object of the present invention is to provide an apparatus for decontaminating an item contaminated with radioactivity by shotblasting or sandblasting the substance for a time sufficient to remove radioactive matter adhered to the surface of the substance; and means for cleaning the surface using a washing solution containing an organic solvent, under conditions sufficient to reduce radioactivity to an acceptably safe level.

A further object of the present invention is also directed to an apparatus for decontaminating materials used to decontaminate items contaminated with radioactivity including means to wash the grit from shotblasting or sandblasting the item with a washing solution; means for rinsing the washed grit with a solution containing a chelating agent; means for filtering the washing solution containing an organic solvent; means for decontaminating and purifying the filtered organic solvent by heating the filtered organic solvent to vaporize it in order to remove residue; means for liquefying the vaporized organic solvent by cooling, and means for recovering the liquified vaporized organic solvent.

The present invention is also directed to a decontaminating apparatus. The decontaminating apparatus contains means for shotblasting or sandblasting; means for washing the grit from the shotblasting or sandblasting with a washing solution containing an organic solvent; means for rinsing the washed grit with a solution containing a chelating agent; means for filtering the organic solvent; and means for decontaminating and purifying the filtered organic solvent, the purifying means including means for heating the filtered organic solvent to remove residue and cooling means for liquefying the heated filtered organic solvent; and means for recovering the liquified organic solvent.

The present invention is also directed to a decontaminating apparatus for decontaminating materials used to decontaminate the radioactively contaminated item, including means for filtration of radioactively contaminated grit; means for washing the grit with organic solvent, means for purifying the organic solvent by vaporizing the organic solvent by heating; means for liquefying the solvent by cooling; and means for washing a chelate liquid using a solution containing a chelate compound.

Further, the present invention is directed to an apparatus for decontaminating materials contaminated with radioactivity, including means for washing the materials using a washing apparatus containing a solution and provided with means for ultrasonic vibration of the solution.

The present invention is also directed to a decontaminating apparatus which contains a vessel containing a solution and means for ultrasonic vibration.

DESCRIPTION OF THE PREFERRED EMBODIMENTS

Definitions

By the terminology "washing solution" is intended a solution containing an organic solvent and optionally one or more members selected from the group consisting of: a Freon and an alcohol. The washing solution is used to clean the surface of a shotblasted or sandblasted contaminated article. The present washing solution is also used to wash contaminated grit.

By the terminology "rinsing solution" is intended a solution containing water, a chelate compound and a surfactant. Such a rinsing solution can be used to rinse the cleaned surface of substance to be decontaminated. Such a rinsing solution can also be used to rinse the first washed grit. Suitable chelate compounds include, for example, KIRESTOOL 7Q by KIREST Chem. Co. Ltd. Suitable surfactants include, for example, a non-ionic surfactant such as R-430 made by Sumitomo 3M Co. Ltd.

By the terminology "organic solvent" is intended any known organic solvent including for example, chlorinated organic solvents. Preferred organic solvents include those that effectively dissolve epoxy resin and zinc oxide coatings. Most preferably, the organic solvent is methylene chloride.

By the term "freon" is intended any known freon including for example, Freon R113.

By the term "grit" is intended any grit known to those of ordinary skill in the art to which the present invention pertains and for example includes: iron grit includes iron grit having a hemi-spherical shape, cut wire, sand, and glass powder.

By the term "alcohol" is intended any alcohol having from 1 to 10 carbon atoms.

By the terminology "cutting powder" is intended any cutting powder known to those of ordinary skill in the art to which the present invention pertains.

By the terminology "acceptably safe range or level" is intended a range or level of radioactivity which is deemed acceptable by the appropriate United States Agency (i.e. OSHA).

The apparatus of the present invention allows for decontamination by either sandblasting or shotblasting the surface of a contaminated article or substance. Any known grit suitable for shotblasting or sandblasting, can be employed in the present invention. Such suitable grit includes for example, iron grit having a hemispherical shape, cut wire, sand, and glass powder.

Figure 1:
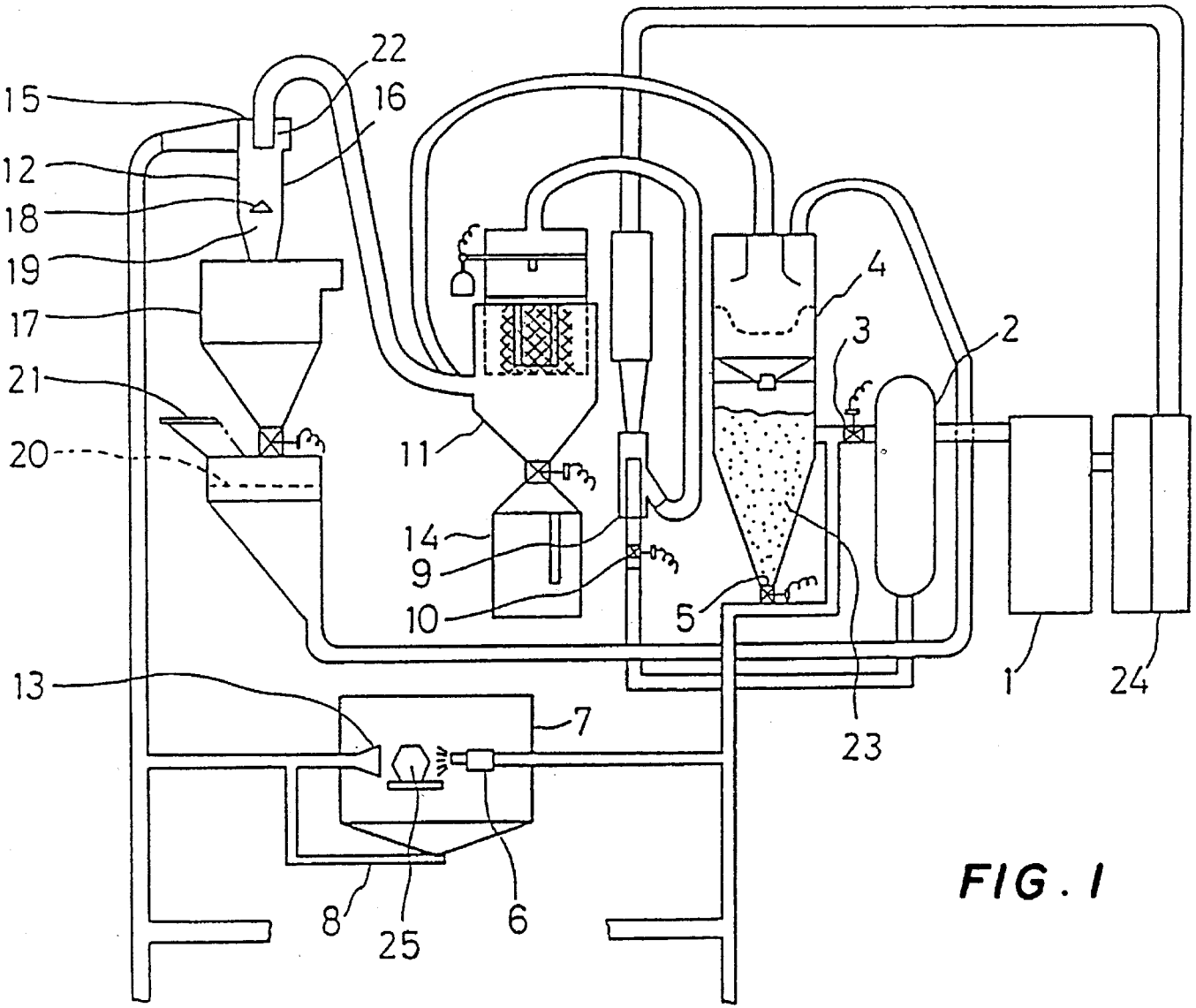
FIG. 1 is a schematic diagram of a preferred embodiment of a decontaminating apparatus according to the present invention.

In FIG. 1, the apparatus includes an air compressor 1 and an air tank 2 where compressed air is held. The grit is blasted through a nozzle 6 by the opening of valves 3 and 5 of tanks 2 and 4, respectively. The apparatus further includes a cutting room 7, a connecting pipe 8, an ejector type of negative pressure generating apparatus 9, which is connected to tank 2 and designed to operate by opening valve 10.

The negative pressure generating apparatus 9 is connected to a sucking port 13 via a filter room 11 and a separating means 12. Further, a confining box 14 is provided for receiving the cutting powder contaminated with radioactivity.

The separating means 12 contains a top cylinder 15, an intermediate cylinder 16, and a hopper 17. The intermediate cylinder 16 is equipped with a conical reversing part 18. The separating means 12 includes a gap 19, and a vibrating sieve 20 and introducing port 21 for fresh grit are also provided. The top cylinder 15 is formed around a discharge cylinder 22, and the entrance port thereof is formed in a tangential direction.

The grit 23 and cutting powder go down inside of the intermediate cylinder 16 with whirling action. The cutting powder then collides with reversing part 18 to turn the stream reversely and upward. The cutting powder then leaves the discharge cylinder 22, enters the filter room 11 and is contained by the confining box 14. The greater mass of grit 23 whirls by centrifugal force near to the inside wall surface of the intermediate cylinder 16, then enters the hopper 17 through gap 19 and is allowed to be sucked into the grit tank 14. The apparatus also includes a sub-filter room 24.

An article 25 contaminated with radioactivity is shown positioned in cutting room 7. The position of the article 25 can be changed by the action of a holding apparatus (not shown in the figure) so that the entire surface of the substance is exposed to grit blasting.

In FIG. 1, the article 25 can be, for example, an iron part which has a non-corrodible coating applied thereon. Such noncorrodible coating can include for example, an undercoating layer containing a zinc oxide-coating, and a topcoating layer containing an epoxy resin-coating. In regard to substances contaminated with radioactivity, some are contaminated by the buildup of scale on a boiler, turbine, turbine blade, or a coated inner wall of a surging tank. In these examples, the surface of the metal part is contaminated with dust, liquid, and/or solids that are mechanically imbedded, or chemically reacted (e.g. adhered) in the coating. Further, scale or oil may exist on the surface of the coating. This type of contamination cannot be effectively removed by wiping the metal part, thus, making it difficult to decontaminate the metal part.

The contaminated article 25, for example, can generally exhibit from 20 to 2000 CPM (Counts Per Minute) when counted by a Geiger counter.

The surface coating layer adhered to article 25 can be removed by shotblasting or sandblasting the exposed surface with grit from nozzle 6 of the shotblasting apparatus, as shown in FIG. 1. The radioactivity of article 25 counted after shotblasting or sandblasting is in the range of from about 0 to 350 CPM (as counted using a Geiger counter).

The article 25 can then be cleaned by washing with a washing solution containing an organic solvent. The washing is conducted in a washing room connected to absorbing means using activated carbon. After washing, the radioactivity of article 25 is from about 0 to 60 CPM (as counted using a Geiger counter).

Next, the article 25 is rinsed with a rinsing solution containing water, a chelating agent and a surfactant in a washing means equipped with an ultrasonic vibrating means. The radioactivity of the article 25 after rinsing is preferably in the range of from about 0 to 20 CPM (as counted using a Geiger counter).

According to the present safety code, an article (e.g. a part or machinery) having 0 CPM can be treated as general industrial waste. The article 25 can then be removed from the nuclear power station for recycling.

In regard to the cleaning step, along with the organic solvent, a Freon (e.g. Freon R113) and/or one or more alcohols can be optionally employed. In place of cleaning by washing, the article 25 can be cleaned by wiping using fabric and solvents.

Figure 2:
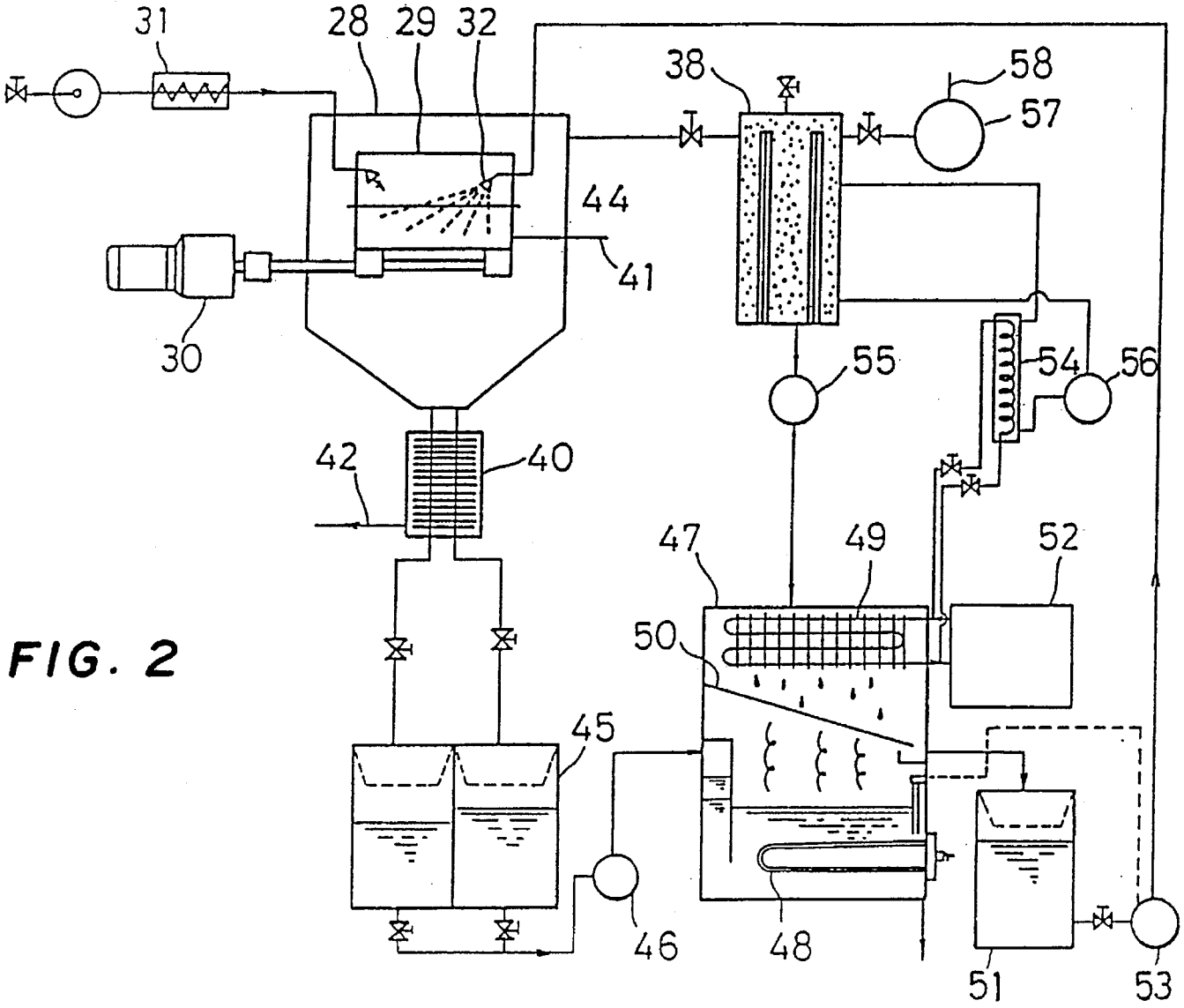
FIG. 2 is a schematic diagram of a preferred apparatus according to the present invention for decontaminating materials used to decontaminate an article contaminated with radioactivity.

After cleaning and rinsing, the washing solution is purified and separated by vaporization due to heating, and liquefied by cooling using the purification apparatus shown in FIG. 2. Such resulting purified solvents have little or no detectable activity (i.e. substantially 0 CPM). When fabric is used for decontamination, it is incinerated and the resulting ash is confined in a suitable solid substance, including for example, concrete or glass. In this case, the volume of fabric to be used will be greatly reduced due to incineration. When the cleaning solution used for cleaning contains cutting powder, the solution is filtered to remove the powder.

The apparatus shown in FIG. 2 is used for the decontamination of the grit used for decontaminating the article in FIG. 1.

The apparatus includes washing means 28 provided with, for example, a rotating screen-lined drum 29 equipped with driving means 30. The drum 29 is preferably made of stainless steel.

Figure 3:
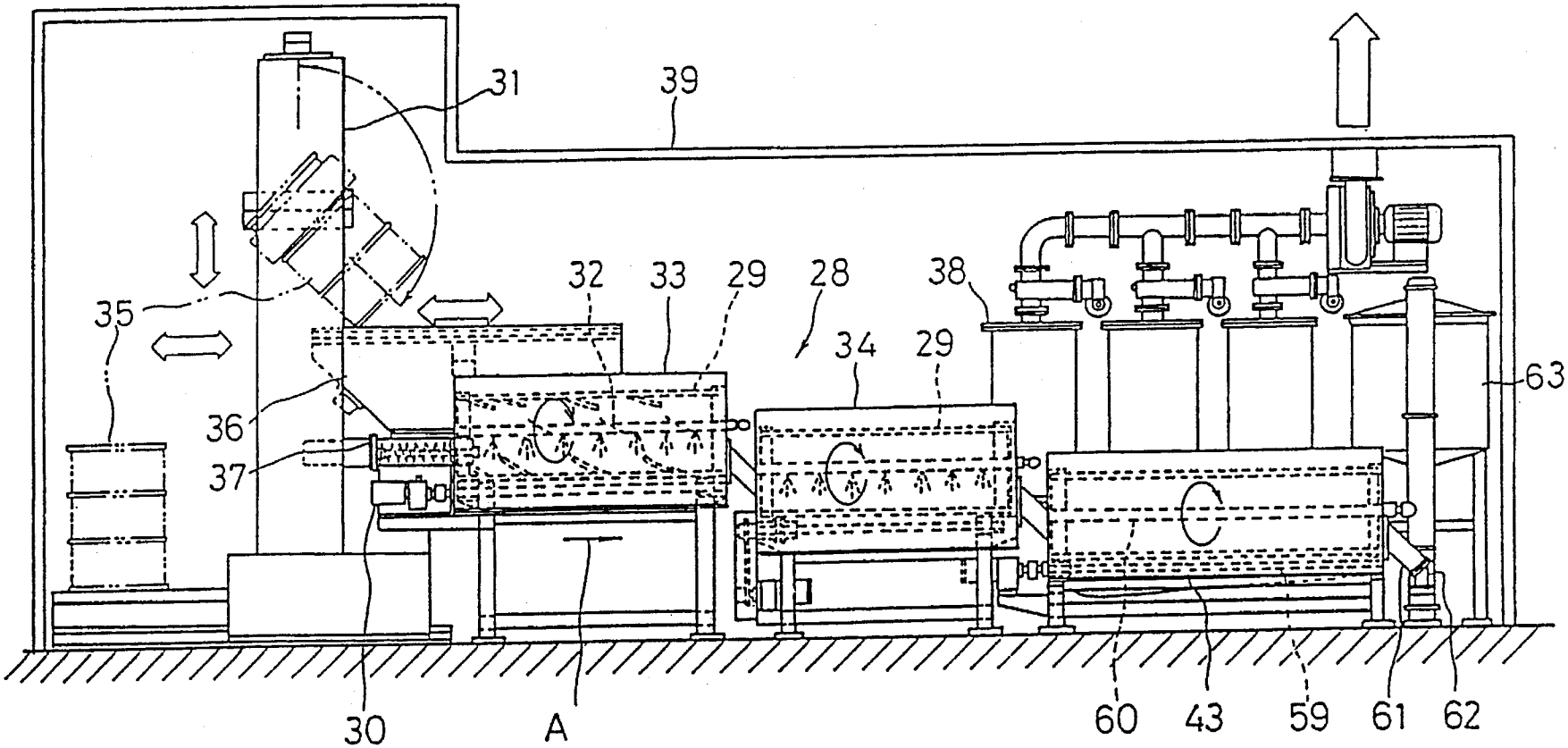
FIG. 3 is a detailed side view of the apparatus shown in FIG. 2.

The washing means also includes grit supplying means 31 and washing liquid spraying means 32. Specific configurations of the grit supplying means 31 and the washing liquid spraying means, are shown in FIG. 3.

The washing means 28 comprises a pre-washing means 33 provided at a position higher above a main washing means 34. The supplying means 31 is equipped with an elevator as shown in FIG. 3 for lifting a vessel 35 (e.g. drum) containing grit. The elevator also tilts the drum at an incline to feed the grit into hopper 36. A screw 37 advances the grit into the pre-washing means 33. Further, the washing means 28 is connected to an absorbing means 38 employing activated carbon.

In FIG. 2, a filtration means 40 is provided beneath washing means 28. Inside the filtration means 40, cutting powder mixed with washing liquid is sandwiched by two pieces of filter fabric, which are subjected to pressure at the external surfaces of the fabrics so as to be squeezed together.

The washing means 28 is also provided with a grit discharging port 41 and a cutting powder discharging port 42.

In FIG. 3, the apparatus is provided with a dryer 43 and containing a washing solution of mainly organic solvent. As for the washing solution, Freon containing solvents, chlorinated organic solvents and alcohols as well as other organic solvents can be suitably used.

Referring to FIG. 2, the apparatus includes a tank 45, a pump 46, and purifying means 47.

The purifying means 47 contains a heater 48, a cooling means 49 and a recovering guide 50. The organic solvent (i.e. washing solution) is heated and vaporized by the heater 48, and allowed to be liquified due to the contact with the cooling means 49. The resulting liquid is dropped onto the recovering guide 50 to be directed into tank 51. The apparatus also includes a freezer 52 and pump 53.

The apparatus includes an absorbing means 38 containing activated carbon. Any conventionally known activated carbon absorbing apparatus can be suitably employed. For example, a gas absorbing apparatus using activated carbon can be used. Such an apparatus is described in U.S. patent application Ser. No. 76089/1989. When gas is absorbed, the activated carbon in the absorbing means 38 is cooled by cooler 54, and the gas (e.g. in the present example, methylene chloride gas) is absorbed.

The activated carbon is then heated by a heater (not shown), and under the same conditions heated carrier air is supplied for the desorption using the same carrier air. Then the carrier air containing the gas is cooled below the boiling point thereof by a liquefying means (not graphically shown) to recover the solvent. Next, any gas which may have escaped from the liquification process is cooled below its freezing point to freeze. The frozen gas is recovered by heating and liquefying. Thus, the gas is substantially recovered. The organic solvent (e.g. methylene chloride in the present example) is recovered and refluxed to the purifying means 47.

The apparatus includes blowers 56 and 57, and a discharging port 58 for clean air is provided.

Referring to FIGS. 2 and 3, the grit having radioactive cutting powder adhered thereon is supplied to pre-washing means 33 of the washing means 28 by supplying means 31. The grit is then sprayed with a washing solution containing an organic solvent from spraying means 32, and washed during the rotation of screen drum 29.

The washed grit then proceeds forward in the direction of arrow A in FIG. 3 with the cutting powder. Finally, the grit drops into main washing means 34 of the next step.

Any washing solution containing an organic solvent that effectively dissolves the epoxy resin and zinc oxide coatings can be used. In the main washing means 34, the grit is similarly washed with a washing solution containing an organic solvent (e.g. methylene chloride is employed in the present example) to remove the cutting powder. The discharged washing solution from the prewashing means 33 reaches filtration means 40 (FIG. 2), and is then filtered to separate it from the cutting powder. The liquid then enters into tank 45, and is eventually transferred to purifying means 47 to be purified.

The purification can be conducted by the use of vaporization, therefore, a small amount of the cutting powder contained in the solvent is completely removed. Accordingly, the decontaminated purified organic solvent preferably has from about 0 to 20 CPM prior to being sent to the main washing means 34. In addition, since the heat of vaporization of an organic solvent is small, decontamination and purification thereof can be easily and effectively carried out.

The washing solution, which inevitably contains a small amount of cutting powder, used in the main washing means 34 is directly supplied to the pre-washing means 33 by a pump not graphically shown.

The grit passing through the main washing means 34 enters into drying means 43, and then goes through a rotating screen drum 59 in the direction of arrow A during which the grit is dried by hot air roma hot air means 60, then discharged from discharging port 61, and then sent into a tank 63 by a conveyor 62.

During operation, gas present in the pre-washing means 33, main washing means 34, and drying means 43, is sucked into the gas absorbing means 38, which uses activated carbon. The gas absorbed is liquefied and refluxed to the purifying means 47. The grit contained in tank 63 has from about 10 to 60 CPM, more preferably from about 20 to 40 CPM, and most preferably about 30 CPM (measured using a Geiger counter).

Figure 4:
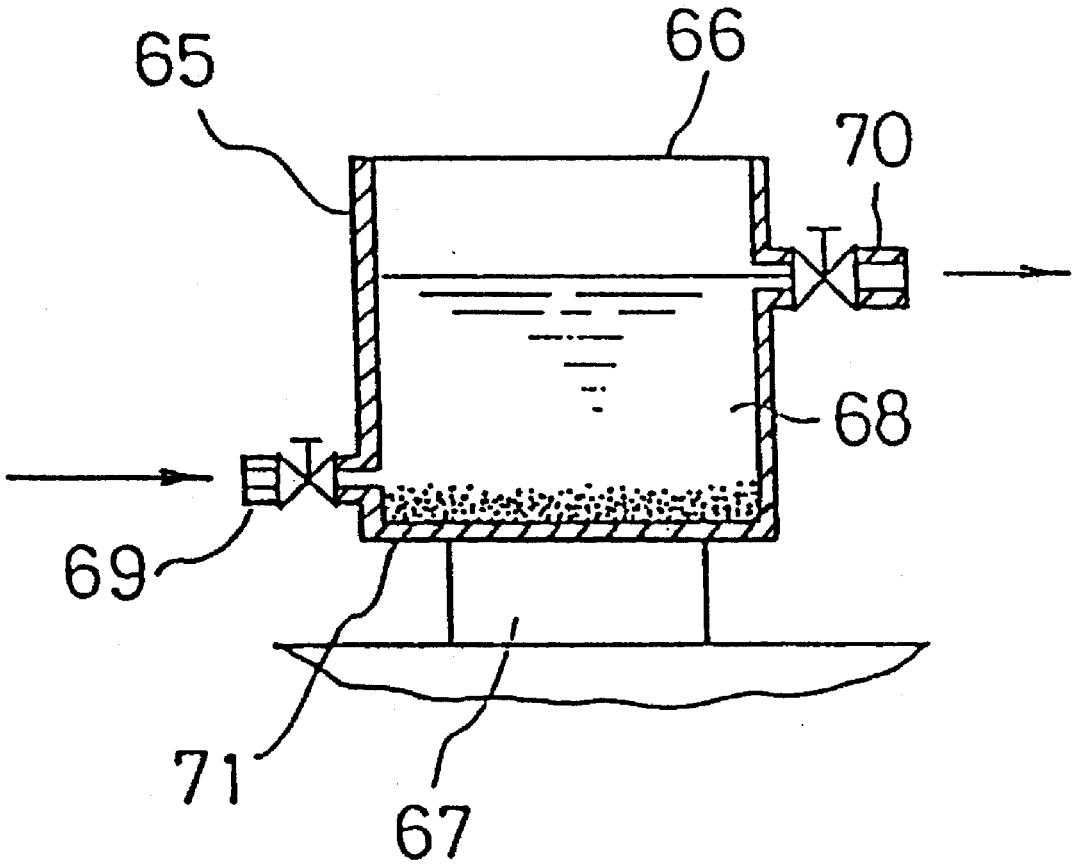
FIG. 4 is a cross-sectional view of the ultrasonic tank of the apparatus according to the present invention.

Referring to FIG. 4, a washing apparatus 65 is shown. The washing apparatus 65 includes a vessel 66 equipped with ultrasonic vibrating means 67.

The vessel 66 contains a rinsing solution 68 containing a chelating agent. The rinsing solution 68 contains water, a chelate compound, and surfactant, which is directed into entrance port 69 and discharged from a discharging port 70. The grit 71 is washed with washing solution containing organic solvent in the vessel 66.

Suitable chelate compounds include for example, KIRESTOOL 7Q made by KIREST Chemistry Company Ltd. Suitable surfactants include, for example, non-ionic surfactants such as R-430 made by Sumitomo 3M Company Ltd. Other suitable chelate compounds and surfactants can be readily selected and employed by one of ordinary skill in the art to which the present invention pertains.

The grit washed by the washing means 28 (FIGS. 2 and 3) is transferred to the washing apparatus 65 containing a rinsing solution containing a chelating agent. The ultrasonic vibrating means 67 is activated during this process. The washing results in ions such as manganese, zinc and iron being bound by the chelating agent.

Radioactive substances are effectively bound by the chelating agent alone, or by the chelating agent in conjunction with ultrasonic vibration.

When the decontamination apparatus is equipped with ultrasonic vibration means, and is used with an organic solvent, a radioactive substance can be effectively decontaminated.

The rinsing solution 68 entering through the entrance port 69 is eventually discharged from the discharging port 70. The chelate agent and surfactant are removed by a means not shown graphically. Then, the grit remaining in the washing apparatus 65 is dried by drying means not graphically shown. The radioactivity of the resulting grit had a count of 0 CPM.

The present invention provides for the decontamination of an article contaminated with radioactivity. The contaminated article is shotblasted or sandblasted to remove the materials and coating(s) adhered to the surface of the substance. Then, the surface is cleaned with liquid; the grit of shotblast or sandblast is washed with an organic solvent; the organic solvent used for the washing is filtered; the organic solvent having residue removed is vaporized by heating; and the vaporized solvent is liquefied and recovered by cooling. As a result of these processes, the article contaminated with radioactivity is effectively and significantly decontaminated.

Additional washing of the grit by the washing apparatus using chelate liquid permits the radioactivity thereof to be substantially removed. The grit from shotblasting or sandblasting the article contaminated with radioactivity is washed with an organic solvent; the organic solvent used for the washing is filtered; the filtered organic solvent is heated and vaporized; and the vaporized organic solvent is liquefied by cooling to obtain purified solvent. As a result of these processes, the material used for the decontamination of the substance contaminated with radioactivity can be fully decontaminated.

Additional washing of the washed grit in the washing apparatus with a rinsing solution containing a chelating agent results in the grit having no radioactivity detectable by a Geiger counter (0 CPM). Thus, the grit is recovered and available for re-use.

When the material (e.g. grit) contaminated with radioactivity is treated in a washing apparatus having ultrasonically vibrated washing solution, the substance is effectively decontaminated.

EXAMPLE

In FIG. 1, the article 25 is a contaminated iron part, which has a non-corrodible coating applied thereon. The non-corrodible coating includes an undercoating layer containing a zinc oxide-coating and a topcoating layer containing an epoxy resin-coating. The article 25 had 800 CPM (Counts Per Minute) when counted by a Geiger counter.

The surface coating layer adhered to article 25 was removed by shotblasting the exposed surface with iron grit having a hemispherical shape from nozzle 6 of the shotblasting apparatus. The radioactivity of article 25 counted after shotblasting (i.e. after removal of coating) was 120 CPM.

The article 25 was then washed with a washing solution containing the organic solvent methylene chloride. The washing was conducted in a washing room connected to an absorbing means using activated carbon. After washing, the radioactivity of article 25 was 30 CPM (as counted using a Geiger counter).

Next, article 25 was rinsed with a rinsing solution containing water, a chelating agent and surfactant in a washing apparatus equipped with ultrasonic vibrating means. The radioactivity of the article 25 after rinsing was 0 CPM. According to the present safety code, a substance (i.e. apparatus or the parts thereof) having 0 CPM can be treated as general industrial waste. The article 25 was then removed from the nuclear power station for recycling.

The grit having radioactive cutting powder adhered thereon is supplied to pre-washing means 33 of the washing means 28 by supplying means 31. The grit is then sprayed with a washing solution which is methylene chloride from a spraying means 32, and washed during the rotation of a screen drum 29. The washed grit then proceeds forward in the direction of arrow A in FIG. 3 with the cutting powder. Finally, the grit drops into main washing means 34 of the next step.

In this process, methylene chloride is employed because it effectively dissolves the epoxy resin and zinc oxide coatings. In the main washing means 34, the grit is similarly washed with methylene chloride to remove the cutting powder. The discharged washing liquid from the pre-washing means 33 reaches filtration means 40, and is filtered to separate it from the cutting powder. The liquid then enters into tank 45, and is transferred to a purifying means 47 to be decontaminated and purified.

In the purifying means 47, the purification is conducted by the use of vaporization, therefore, a small amount of the cutting powder contained in the solvent is completely removed. Accordingly, the decontaminated purified methylene chloride has 0 CPM prior to being sent to the main washing means 34.

In addition, since the heat of vaporization of an organic solvent is small, purification thereof can be easily and effectively carried out.

The washing solution, which inevitably contains a small amount of cutting powder, used in the main washing means 34 is directly supplied to the pre-washing means 33 by a pump not graphically shown.

The grit passing through the main washing means 34 enters into a drying means 43, and then goes through rotating screen drum 59 in the direction of arrow A during which the grit is dried by hot air from hot air means 60, then discharged from discharging port 61 and sent into a tank 63 by a conveyor 62.

During operation, gas present in the pre-washing means 33, the main washing means 34 and the drying means 43, is sucked into the gas absorbing means 38 which uses activated carbon. The gas absorbed is liquefied and refluxed to the purifying means 47. The grit contained in tank 63 has a radioactivity of 30 CPM.

The washing apparatus 65 shown in FIG. 4 uses a rinsing solution. The washing apparatus 65 includes a vessel 66 equipped with ultrasonic vibrating means 67. The rinsing solution 68 contains water, a chelate compound and surfactant, and is directed into entrance port 69 and discharged from discharging port 70. The grit was washed with methylene chloride.

The chelating compound used was KIRESTOOL 7Q made by KIREST Chemistry Company Ltd. The surfactants used was the non-ionic surfactant R-430 made by Sumitomo 3M Company Ltd.

The apparatus shown in FIG. 2 is described below. The grit washed by the washing apparatus 28 is transferred to washing apparatus 65 containing a rinsing solution, and is rinsed with the rinsing solution containing a chelating agent by using the ultrasonic vibrating means 67. In this case, ions which are bound by the chelating agent include manganese, zinc and iron ions.

Radioactive substances are effectively bound by the chelating agent or the chelating agent in conjunction with ultrasonic vibration.

The washing liquid 68 enters at the entrance 69 and is discharged from the discharging port 70 where the chelate agent and surfactant are removed by means not shown graphically. Then the grit which left the washing means using chelate liquid is dried by drying means not graphically shown. The radioactivity of the resulting grit counted was 0 CPM.

Additional washing of the washed grit in the washing apparatus with a rinsing solution containing a chelating compound results in the grit having no radioactivity detectable by a Geiger counter (0 CPM). Thus, the grit is recovered and available for reuse.

What is claimed is:

1. An apparatus for decontaminating an article contaminated with radioactivity, comprising:

means for blasting said article with grit under conditions sufficient to remove radioactively contaminated material adhered to the surface of said article to produce a blasted article;

means for washing grit contaminated with radioactivity from the article to remove radioactivity from the grit to allow reused thereof: and means for purifying an organic solvent used to wash the radioactively contaminated grit by vaporizing the solvent by heating and then liquefying the solvent by cooling.

2. An apparatus according to claim 1, including filtering means washing the grit for removing said radioactively contaminated material from the surface of said grit.

3. An apparatus according to claim 2, including means for purifying an organic solvent used to wash the radioactively contaminated grit by vaporizing the solvent by heating and then liquefying the solvent by cooling.

4. An apparatus according to claim 1, wherein the organic solvent is optionally provided with one or more members selected from the group consisting of an alcohol and a freon, to effectively remove radioactivity contaminated material from said grit.

5. An apparatus according to claim 3, wherein the organic solvent is optionally provided with one or more members selected from the group consisting of an alcohol and a freon, to effectively remove radioactivity contaminated material from said grit.

6. An apparatus according to claim 1, wherein said washing means includes a rotating screen drum for washing said grit.

7. An apparatus according to claim 1, including a vessel containing a liquid having an ultrasonic vibration means for rinsing said grit.

8. An apparatus according to claim 7, wherein said washing means further includes grit supplying means and liquid spraying means for applying radioactivity contaminated grit and liquid into said rotating screen drum to remove radioactivity contaminated material from said grit.

9. An apparatus according to claim 1, including means for decontaminating materials used to decontaminating the article contaminated with radioactivity, including:

means to wash the grit from blasting with a washing solution;

means for rinsing the washed grit with a solution containing a chelating agent;

means for filtering the washing solution containing an organic solvent;

means for decontaminating and purifying the filtered organic solvent by heating the filtered organic solvent to vaporize it in order to remove residue;

means for liquefying the vaporized organic solvent by cooling, and means for recovering the liquified vaporized organic solvent.

10. An apparatus for decontaminating an article contaminated with radioactivity, comprising:

means for blasting the article with grit under conditions sufficient to remove material adhered to the surface of the article to produce a blasted article;

means for cleaning the blasted article with a washing solution comprising an organic solvent and optionally one or more members selected from the group consisting of: an alcohol, and a freon to produce a cleaned substance;

means for washing said grit with a washing solution, said washing solution comprising an organic solvent and optionally one or more members selected from the group consisting of a Freon and an alcohol to produce a first washed grit;

means for filtering the washing solution to produce a filtered solvent; and means for decontaminating the filtered solvent to produce a decontaminated purified solvent.

11. An apparatus for decontaminating materials used to decontaminate an article contaminated with radioactivity, comprising:

means to wash grit from blasting the article with a washing solution;

means for rinsing the washed grit with a solution containing a chelating agent;

means for filtering the washing solution containing an organic solvent;

means for decontaminating and purifying the filtered organic solvent by heating the filtered organic solvent to vaporize it in order to remove residue;

means for liquefying the vaporized organic solvent by cooling, and means for recovering the liquified vaporized organic solvent.

* * * * *